US010563361B2

(12) United States Patent
White, Jr. et al.

(10) Patent No.: US 10,563,361 B2
(45) Date of Patent: Feb. 18, 2020

(54) SYSTEM AND METHOD FOR CUSTOMIZING A PLAYING FIELD

(71) Applicant: VERSACOURT, LLC, Dalton, GA (US)

(72) Inventors: Steve White, Jr., Dalton, GA (US); Ron Bennett, Dalton, GA (US)

(73) Assignee: CH3 SOLUTIONS, LLC, Dalton, GA (US)

( * ) Notice: Subject to any disclaimer, the term of this patent is extended or adjusted under 35 U.S.C. 154(b) by 0 days.

(21) Appl. No.: 16/114,113

(22) Filed: Aug. 27, 2018

(65) Prior Publication Data

US 2019/0017230 A1 Jan. 17, 2019

Related U.S. Application Data

(63) Continuation-in-part of application No. 15/404,527, filed on Jan. 12, 2017, now Pat. No. 10,060,083.

(60) Provisional application No. 62/277,661, filed on Jan. 12, 2016.

(51) Int. Cl.

| | |
|---|---|
| ***E01C 13/08*** | (2006.01) |
| ***E01C 13/02*** | (2006.01) |
| ***E01C 17/00*** | (2006.01) |
| ***E01C 13/04*** | (2006.01) |
| ***E01C 11/02*** | (2006.01) |
| ***E01C 5/00*** | (2006.01) |
| ***E01C 5/20*** | (2006.01) |

(52) U.S. Cl.

CPC ..... *E01C 13/02* (2013.01); *E01C 5/003* (2013.01); *E01C 5/20* (2013.01); *E01C 11/02* (2013.01); *E01C 13/04* (2013.01); *E01C 13/045* (2013.01); *E01C 13/08* (2013.01); *E01C 13/083* (2013.01); *E01C 17/00* (2013.01); *E01C 2201/10* (2013.01); *E01C 2201/16* (2013.01); *E01C 2201/20* (2013.01)

(58) Field of Classification Search

CPC ..... E01C 13/02; E01C 13/08; E01C 13/083; E01C 17/00

USPC ..... 404/27, 71

See application file for complete search history.

(56) References Cited

U.S. PATENT DOCUMENTS

| | | | |
|---|---|---|---|
| 1,393,699 | A | 10/1921 | Purcell et al. |
| 4,193,573 | A | 3/1980 | Kinnucan |
| 4,436,779 | A | 3/1984 | Menconi et al. |
| 4,584,221 | A | 4/1986 | Kueng |
| 4,930,286 | A | 6/1990 | Kotler |
| 4,980,117 | A | 12/1990 | Blaushild |
| 5,134,386 | A | 7/1992 | Swanic |

(Continued)

*Primary Examiner* — Gary S Hartmann

(74) *Attorney, Agent, or Firm* — Lathrop GPM LLP

(57) ABSTRACT

A customizable playing field includes a turf system comprising a tile with a turf layer. The tile overlays a subfloor, defining a reservoir thereunder. A forced air system includes a pipe disposed within the reservoir and operatively coupled to a pump; and a sensor. A control system controls the pump, and includes a processor in data communication with at least one input/output device and computer memory. The computer memory has a program with machine readable instructions that, when effected by the processor, perform the following steps: if the temperature is above a predetermined threshold as measured by the sensor, forcing a cool fluid through the pipe; and if the temperature is below a predetermined threshold as measured by the sensor, forcing a warm fluid through the pipe.

20 Claims, 10 Drawing Sheets

(56) References Cited

U.S. PATENT DOCUMENTS

| | | | | |
|---|---|---|---|---|
| 5,596,836 | A * | 1/1997 | Benson | A01B 45/02 47/1.01 R |
| 5,988,942 | A | 11/1999 | Atkinson | |
| 6,715,956 | B1 * | 4/2004 | Weber | E01C 5/20 404/18 |
| 6,800,339 | B2 | 10/2004 | Motz et al. | |
| 6,950,599 | B2 | 9/2005 | Nicholls et al. | |
| 7,081,283 | B2 | 7/2006 | Straughn | |
| 7,086,205 | B2 | 8/2006 | Pervan | |
| 7,172,366 | B1 * | 2/2007 | Bishop, Jr. | E01C 13/02 137/78.3 |
| 7,245,815 | B2 | 7/2007 | Nicholls et al. | |
| 7,413,380 | B2 * | 8/2008 | Corwon | E01C 13/02 137/78.3 |
| 7,486,868 | B1 | 2/2009 | Seacat et al. | |
| 7,532,781 | B2 | 5/2009 | Thompson et al. | |
| 7,748,177 | B2 | 7/2010 | Jenkins et al. | |
| 7,874,761 | B2 | 1/2011 | Prokhorenkov et al. | |
| 7,993,729 | B2 | 8/2011 | Wise | |
| 8,308,332 | B1 | 11/2012 | Suhr | |
| 9,039,541 | B2 | 5/2015 | De Vries et al. | |
| 9,157,197 | B2 * | 10/2015 | Kim | E01C 7/04 |
| 9,476,166 | B2 * | 10/2016 | Hydock | E01C 11/26 |
| 9,851,935 | B1 * | 12/2017 | Cohen | G06F 3/1423 |
| 10,060,083 | B2 * | 8/2018 | White, Jr. | E01C 13/04 |
| 2006/0236760 | A1 | 10/2006 | Belisle | |
| 2007/0223993 | A1 | 9/2007 | Peterson et al. | |
| 2009/0036200 | A1 | 2/2009 | Seacat et al. | |
| 2009/0088234 | A1 | 4/2009 | Seacat et al. | |
| 2009/0240695 | A1 | 9/2009 | Angell et al. | |
| 2009/0246418 | A1 | 10/2009 | Wise | |
| 2009/0305823 | A1 | 12/2009 | Belisle | |
| 2010/0154216 | A1 | 6/2010 | Hulen | |
| 2011/0023934 | A1 | 2/2011 | Xue et al. | |
| 2011/0117297 | A1 | 5/2011 | Harmeling | |
| 2011/0260890 | A1 | 10/2011 | Larsen et al. | |
| 2013/0243367 | A1 | 9/2013 | Belisle | |
| 2015/0013119 | A1 | 1/2015 | Beamish | |
| 2015/0104257 | A1 | 4/2015 | Cooley et al. | |
| 2015/0113842 | A1 | 4/2015 | Suhr | |
| 2015/0368866 | A1 | 12/2015 | Hydock | |
| 2017/0191227 | A1 | 7/2017 | Sylvester | |
| 2018/0102730 | A1 * | 4/2018 | Brusaw | G08G 1/0116 |
| 2018/0121151 | A1 * | 5/2018 | Cohen | G06F 3/1423 |

* cited by examiner

FIG. 1 –
PRIOR ART

SYSTEM AND METHOD FOR CUSTOMIZING A PLAYING FIELD

CROSS-REFERENCE TO RELATED APPLICATIONS

This application is a continuation-in-part of U.S. patent application Ser. No. 15/404,527, filed Jan. 12, 2017, which is pending and claims priority to U.S. Provisional Patent Application No. 62/277,661, filed Jan. 12, 2016, which is incorporated herein by reference in its entirety.

BACKGROUND

It is estimated that the world-wide, synthetic turf, multi-purpose field market is around 60,000,000 square feet per year, which equates to around $500,000,000 per year spent on synthetic turf. The popularity of the synthetic turf industry is bolstered by the many benefits offered by synthetic turf, including eliminating the necessity of mowing the grass and worrying about growing grass in difficult areas. However, there are also several drawbacks of current synthetic turf systems.

For example, in the current method of installing synthetic turf, rubber is used as an infill. Rubber serves the important purpose of acting as a shock absorption layer, or attenuation layer. However, there are some concerns that ground-up rubber may cause cancer. Additionally, synthetic turf is around 35 degrees higher in temperature than natural grass fields. As a result of the higher temperature of the grass, heat exhaustion occurs more quickly for those on the synthetic turf.

Another large drawback is the significant cost associated with the purchase and installation of a synthetic turf field. On average, a synthetic turf field costs around $600,000, with most of that cost attributed to the work done below the surface (e.g., drainage and rock stabilization. Moreover, a single type of synthetic turf field is not appropriate in all situations. But due to the high cost, most fields are installed using an infill ratio of rubber to sand which favors the most prevalently played sport in that market. For example, in the Southern United States, this is American football. However, fields may be primarily designed for soccer, lacrosse, baseball, or any other type of sport where artificial turf fields are desirable.

Accordingly, it may be beneficial to have a synthetic turf system that can be used with multiple sports and without the drawbacks of current synthetic turf systems.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In one embodiment, a customizable playing field includes a turf system comprising a tile with a turf layer. The tile overlays a subfloor, defining a reservoir thereunder. A forced air system includes a pipe disposed within the reservoir and operatively coupled to a pump; and a sensor. A control system controls the pump, and includes a processor in data communication with at least one input/output device and computer memory. The computer memory has a program with machine readable instructions that, when effected by the processor, perform the following steps: if the temperature is above a predetermined threshold as measured by the sensor, forcing a cool fluid through the pipe; and if the temperature is below a predetermined threshold as measured by the sensor, forcing a warm fluid through the pipe.

In another embodiment, a customizable playing field, includes a turf system comprising a tile having a turf layer disposed thereon, the tile overlaying a subfloor defining a reservoir; a plurality of adjustable actuator supports positioned between the subfloor and the tile; and a plurality of sensors. A control system is operable to adjust the actuator, and comprises a processor in data communication with at least one input/output device, and computer memory. The computer memory includes a program having machine readable instructions that, when effected by the processor, perform the following steps: (1) determine a position of a player upon the turf system; and (2) predict a location of an impact by the player upon the turf system; (3) determine at least one actuator support of the plurality of adjustable actuator supports within a predetermined radius of the predicted impact location; and (4) adjust the at least one actuator to reduce the tension therein, wherein the actuator receives and deflects at least a portion of the impact from the player, an impact upon the player thereby being reduced.

In still another embodiment, a customizable playing field includes a turf system comprising a tile having a turf layer disposed thereon, the turf layer comprising a plurality of light emitting fibers; and a plurality of sensors. A control system is operable to activate the light emitting fibers, the control system comprising a processor in data communication with at least one input/output device, and computer memory. The computer memory has a program with machine readable instructions that, when effected by the processor, perform the following steps: determine a first position of a player upon the turf system; activate a first portion of the light emitting devices based on the first location of the player; determine a second position of the player upon the turf system; and activate a second portion of the light emitting devices based on the second location of the player.

WRITTEN DESCRIPTION

Embodiments of synthetic turf systems are disclosed herein. It shall be recognized that the various system components described herein may be individually beneficial, or may be combined as part of a more comprehensive synthetic turf system.

Figure 1:
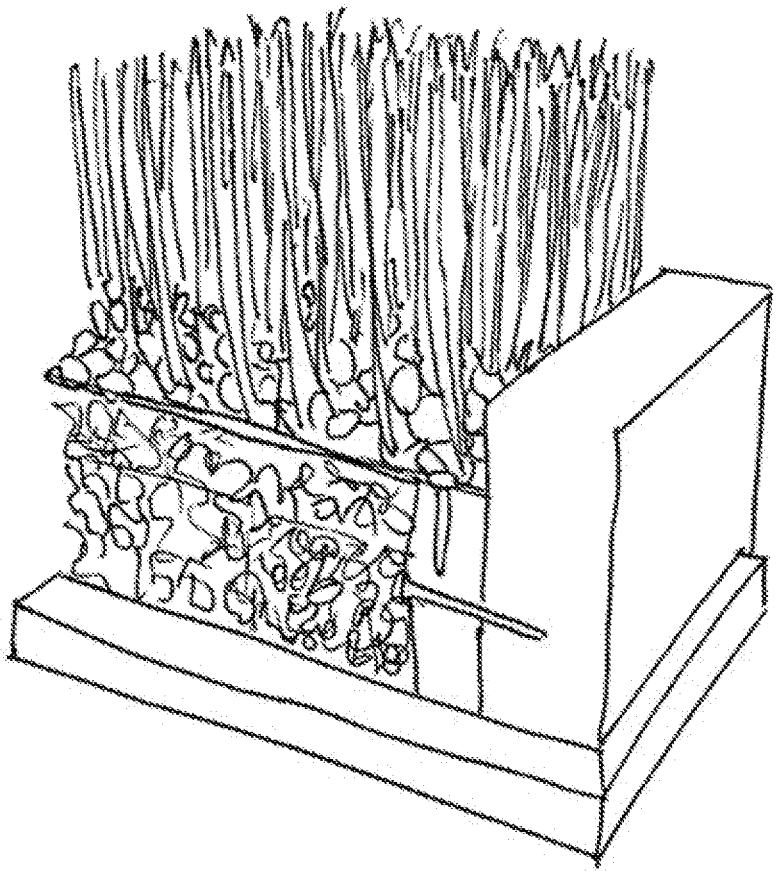
FIG. 1 is a section view of a prior art synthetic turf system according to one embodiment of the invention.

In one embodiment of the invention, a synthetic turf system includes a modular surface (e.g., tiles) to which the synthetic turf may be applied. The modular surface may eliminate the need for nearly 75% of the rock used in current synthetic turf sub-bases. FIG. 1 illustrates a prior art system showing such a sub-base. As described in greater detail herein, the tiles may be rigid enough to support itself and other tiles throughout the surface to ensure a stable playing surface. It shall be understood that the tiles may be configured in a variety of different shapes and sizes depending on the requirements of the surface to be covered.

Figure 2:
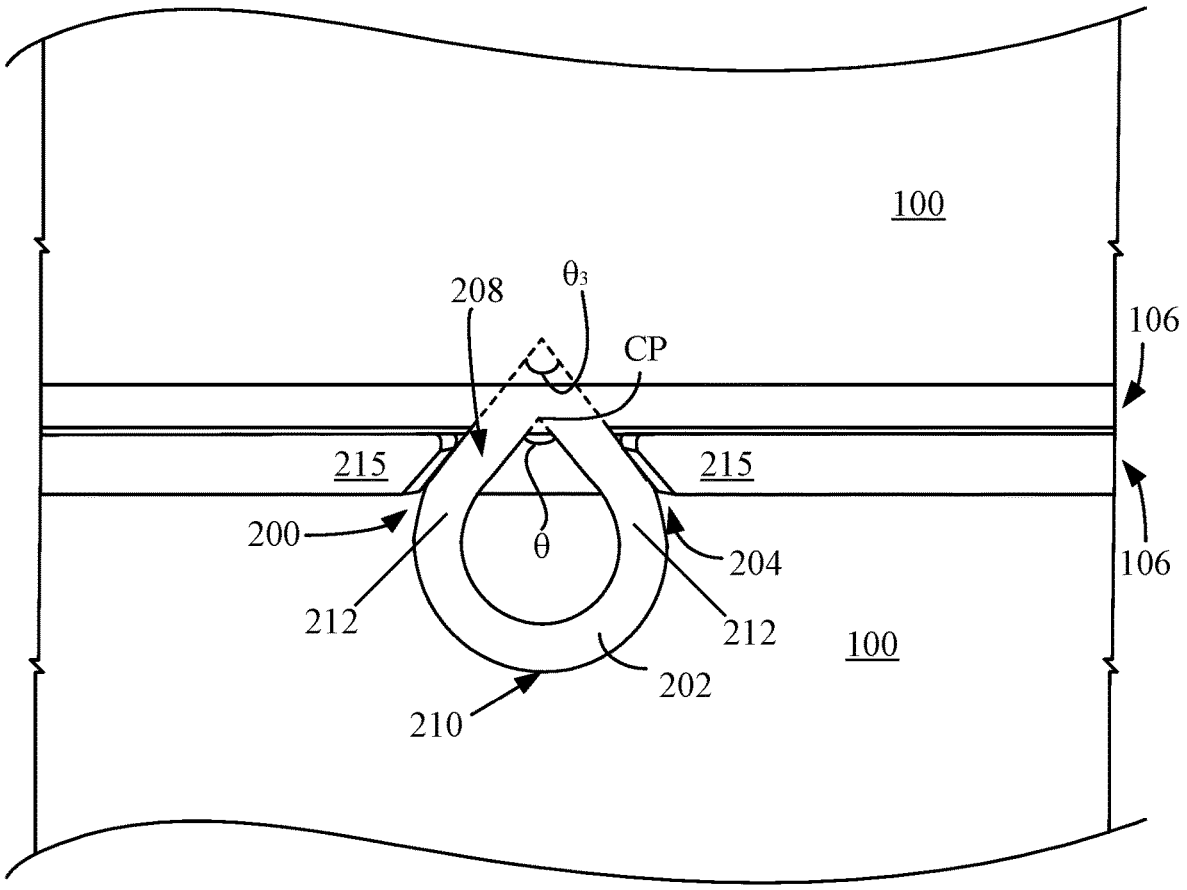
FIG. 2 is a bottom view of a tension spring system according to one embodiment of the invention.
Figure 3:
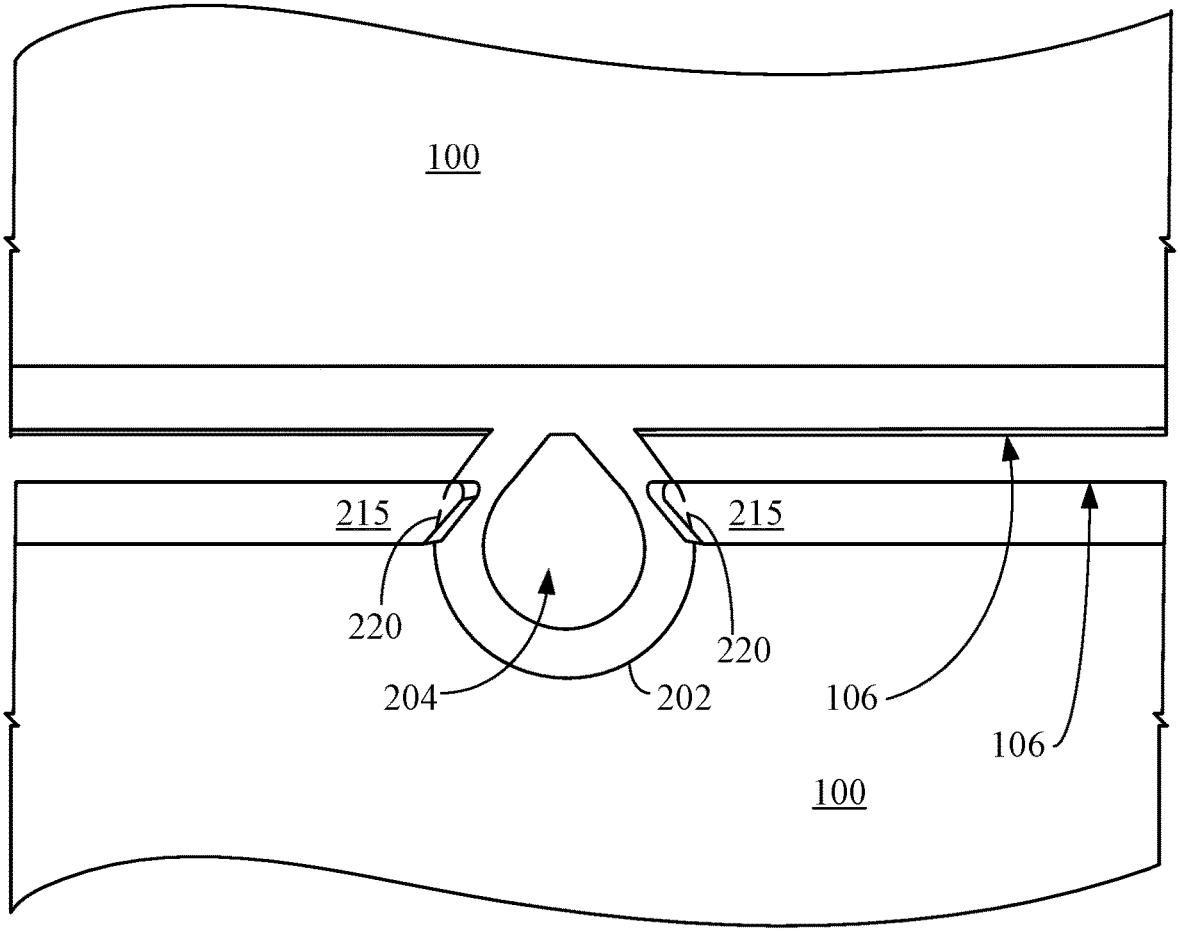
FIG. 3 is a bottom view of the tension spring system according to the embodiment of FIG. 2.
Figure 4:
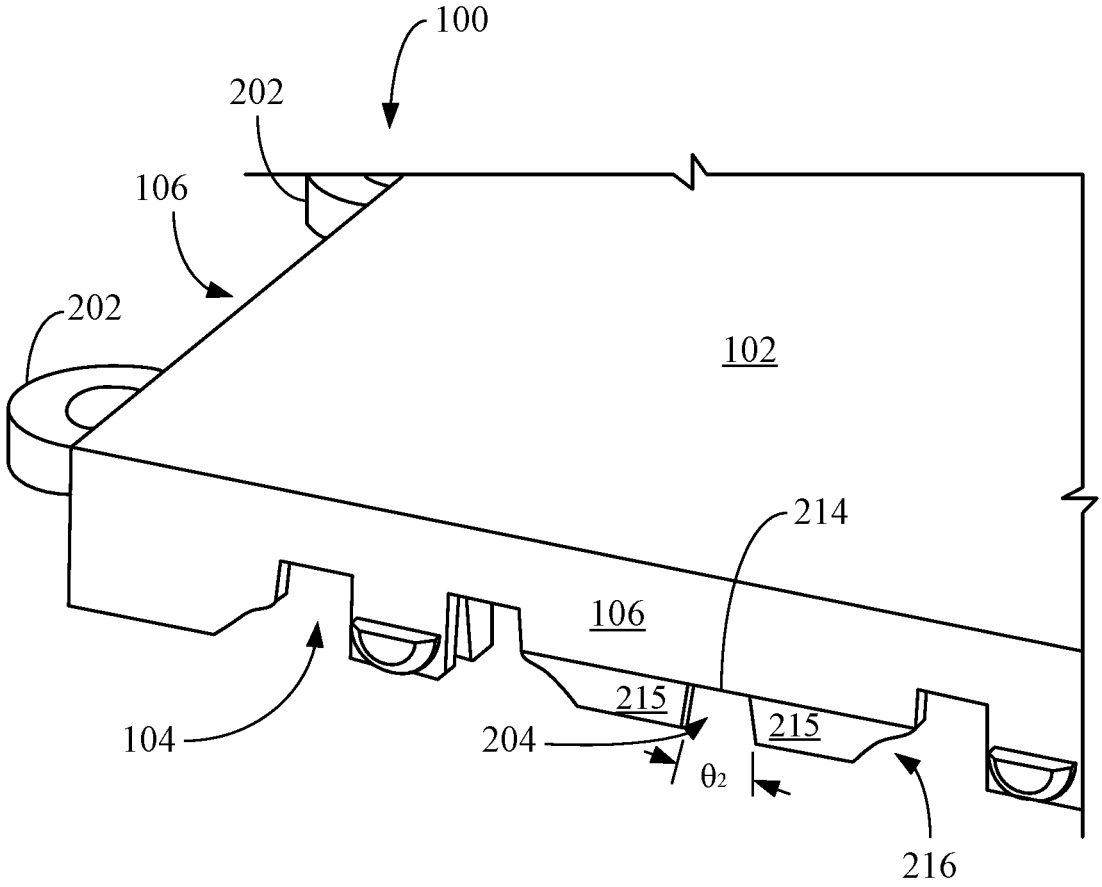
FIG. 4 is a perspective side view of a tile showing components of the tension spring system of FIG. 2.

Referring now to FIGS. 2-4, in one embodiment, a tile 100 includes a top surface 102 and a bottom surface 104, and respective edges 106 extending between the top and bottom surfaces 102 and 104. The top surface 102 may be equipped to receive synthetic turf thereupon. The bottom surface may include a plurality of support pegs. The support pegs help to provide support to the tile 100 from the underside, to prevent structural failure of the tile 100.

Each tile may be equipped with a spring tension system 200 for joining multiple tiles together. The spring tension system 200 may include a plurality of tension spring loops 202 and corresponding tapered recesses 204.

The tension spring loop 202 may be molded (e.g., via injection molding, co-injection molding, overmolding, multi-material injection molding, etc.) as part of a tile 100. One or more loops 202 may be formed along a single side 106 of a tile 100. Preferably, one or more loops 202 may be formed along multiple sides 106 of the tile 100 (e.g., along two adjacent sides 106, along three adjacent sides 106, along all four sides 106, and/or along two parallel sides 106). In one embodiment, each tile 100 has a plurality of tension spring loops 202 formed along two adjacent sides 106 of the tile.

The tension spring loop 202 has a base portion 208 and a hoop portion 210. The base portion 208 extends directly from the side 106 of the tile 100. The base portion 208 has two arms 212 extending at an angle θ from a center point CP at the base of the loop 202. The angle θ between the respective arms 212 may range from approximately 60 degrees to approximately 90 degrees. Preferably, the angle θ is about 75 degrees, and most preferably the angle θ is approximately 80 degrees.

The tension spring loop 202 may be formed of a resilient material that allows the loop 202 to flex. Accordingly, in one embodiment, it may be beneficial for the tension spring loop 202 to be co-molded with the tile 100, wherein the tile 100 is formed of a plastic material, such as a high-impact polypropylene polymer having a higher durometer value (indicating a harder material), while the loop 202 may be formed of a material such as a polypropylene polymer having a lower durometer (indicating a softer material). In another embodiment, the tension spring loop 202 and the tile 100 may be formed of the same material.

The tension spring loop 202 may be configured to be received by a tapered recess 204 on another tile 100. A plurality of tapered recesses 204 may be formed along multiple sides 106 of a tile 100 (e.g., along two adjacent sides 106, along three adjacent sides 106, along all four sides 106, and/or along two parallel sides 106). In one embodiment, each tile 100 has a plurality of tapered recesses 204 formed along two adjacent sides 106 of the tile 100. The adjacent sides 106 of the tile 100 having the tapered recesses 204 may thus be the sides 106 that do not have tension spring loop(s) 202. Accordingly, in one embodiment, two adjacent sides 106 of the tile 100 may be equipped with tension spring loops 202, and the other two adjacent sides 106 of the tile 100 may be equipped with tapered recesses 204.

The number of tapered recesses 204 may correspond to the number of loops 202. For example, if each tile 100 has two loops 202 per each of the sides 106 having loops 202, the sides having the tapered recesses 204 may each have two tapered recesses 204. It shall be understood that the tiles 100 in a system may be uniformly manufactured for easy and uniform installation.

The tapered recess 204 may be comprised of an opening 214 formed into a panel 216 on the respective side 106. The walls 215 of the opening 214 may have a front angle $\theta_2$ of between approximately 5 degrees and 15 degrees. Preferably, the angle $\theta_2$ is approximately 10 degrees.

The panel 216 may have a width W (FIG. 3) sufficient to maintain the tension spring 202 in the recess 204. In one embodiment, the width W is approximately between ⅛" and 0.5". In another embodiment, the width W is approximately between 0.25" and 0.75". As shown in FIG. 2, an angle $\theta_3$ of the inside edges of the walls 215 may generally correspond to angle θ. In one embodiment, angle $\theta_3$ is slightly smaller than angle θ (e.g., approximately between 70 and 80 degrees).

Prior art tiles employ locking means that promote holding the locked tiles as far apart as possible. This is to allow for expansion and contraction of the tile due to forces on the tiles, as well as due to changes in the environment (e.g., temperature). As a result, there is almost always a gap between the tiles. When a user moves over the tiles, the tiles flex, and the gap may close on the user causing the user to be pinched.

The novel tension system described herein works in reverse. In use, the tension spring loop(s) 202 on one side 106 of a tile 100 are inserted into respective tapered recesses 204 formed into a side 106 of another tile as illustrated in FIG. 2. To insert the tension spring loop 202 into the tapered recess 204, the loop 202 is deformed such that the hoop end 210 fits into the opening 214. The loop 202 may be deformed automatically when force is exerted on the tiles in a manner as to cause the tiles 100 to attach. Once the hoop end 210 is through the initial opening 214, the natural flexibility of the material causes the hop end 210 to return to its original shape. The spring loop 202 and the tapered recess 204 thus form an interference fit.

The interference fit causes the respective tiles 100 to be constantly and consistently drawn to one another. The tiles 100 are therefore not maintained in a spaced-apart position like prior art system, but rather meet at respective sides 106, and the space between the tiles 100 is therefore minimized. FIG. 2 illustrates two tiles 100 which are shown at a minimum spacing. Here, the tension spring loop 202 is slightly compressed and under tension.

Figure 5:
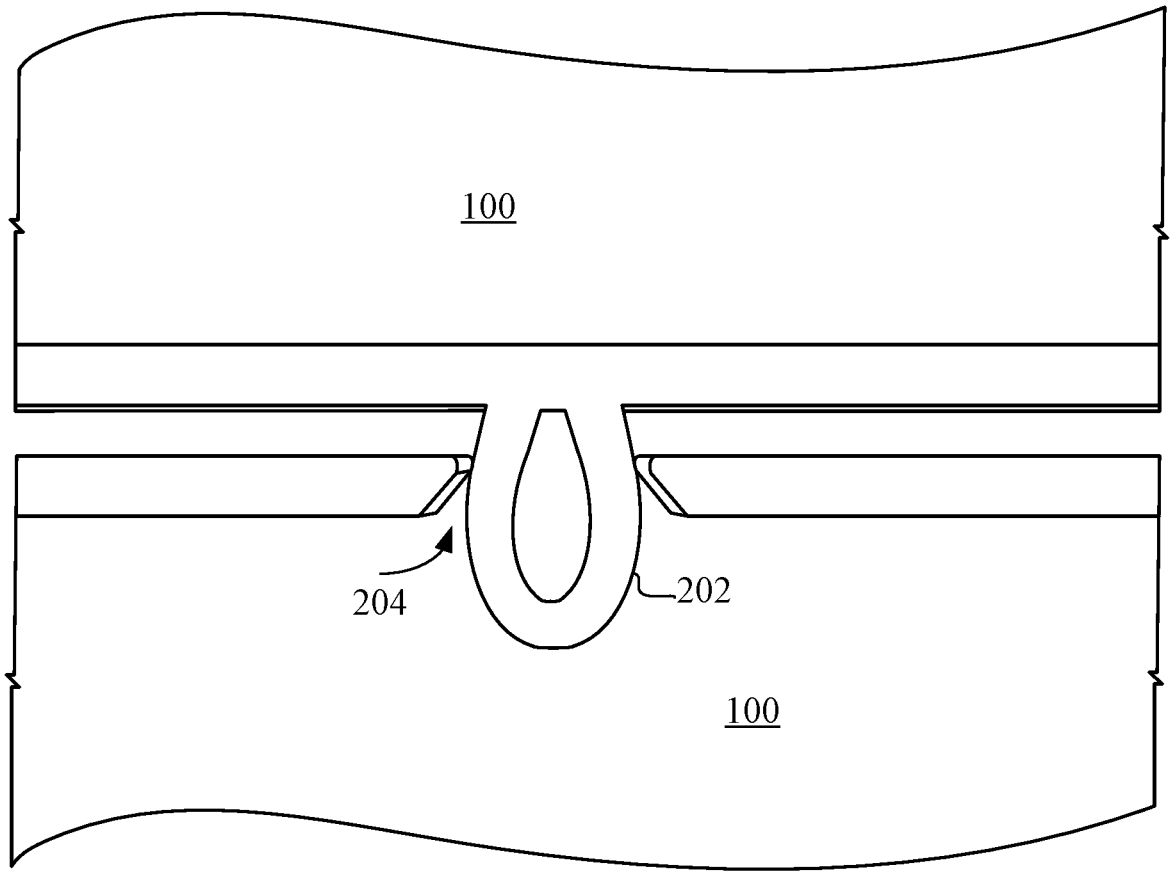
FIG. 5 is another perspective view of a tile showing components of the tension spring system of FIG. 2.

However, it may still be desirable for the tiles 100 to be able to accommodate changes in the environment of the tiles 100 due to expansion and compression. Due to the flexible nature of the material of the tile 100 generally, and the tension spring loop 202, the tile may 100 experience a force (e.g., due to movement of humans or animals across the surface, or a change in the environment such as temperature) sufficient to overcome the tension force between the spring loop 202 and the tapered recess 204 causing the base portion 208 of the spring loop 202 to be partially separated from the tapered recess 204, as shown in FIG. 3. Here, the spring loop 202 may be compressed, which increases interference with the tapered recess 204. A greater inward pressure would therefore be received by each respective tile 100. Lines 220 in FIG. 3 show the movement of the spring loop 202 away from the recess 204. However, due to the flexible nature of the spring loop 202, and the presence of the walls 215 of the recess 204, the spring loop 202 compresses, as shown FIG. 5. This compression increases the tension between the recess 204 and the spring loop 202. When the force is removed, this tension on the spring loop 202 causes the tiles 100 to draw back together.

The force (e.g., tension) created between the tiles 100 can be varied based on the requirements of the various systems. In order to vary the tension, greater or fewer spring loops 202 may be incorporated into respective sides 106 of the tiles 100 (e.g., three spring loops 202 on two adjacent sides 106 of a tile 100). Further, the shape, size, and wall thickness of each the spring loops 101 may be varied to provide greater or lesser tension to the system. For example, a spring loop 202 having a larger wall thickness will require a greater amount of force to overcome the tension in the system in order to separate the tiles 100. Conversely, a spring loop 202 with a smaller wall thickness will require a smaller amount of force to overcome the tension in the system in order to separate the tiles 100. Likewise, increasing and/or decreasing the angles $\theta$, $\theta_2$, and $\theta_3$ may effect the overall tension of the system.

The tiles 100 may be incorporated into a customized playing field system as described below. The customized playing field is configured to allow a user to optionally utilize various customized settings which adjust parameters of the playing field to best support a particular activity being played on the playing field. Specifically, it may be desirable for a playing field to exhibit varying levels of flexibility (i.e., give) depending on the sport being played. Accordingly, it may be desirable to customize the flexibility of the playing field based on the sport. Other customizable features may additionally, or alternately, be desirable.

Figure 6:
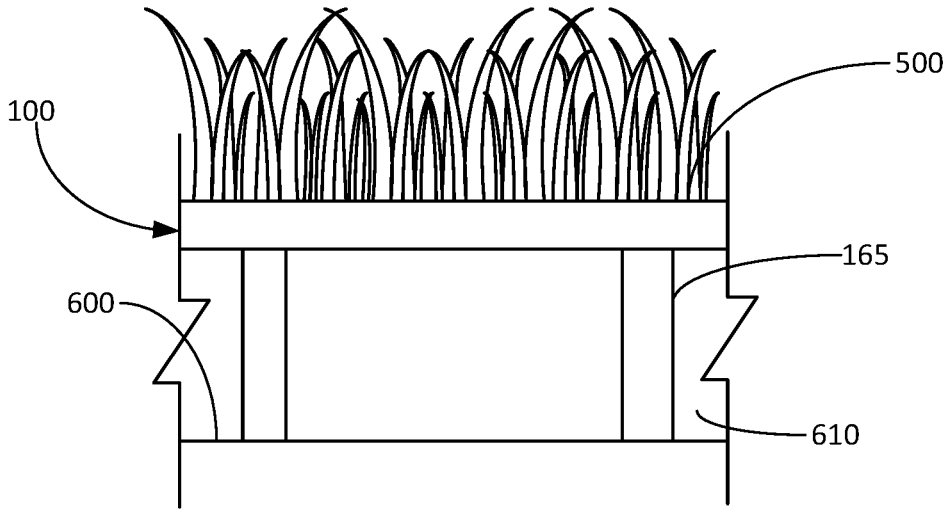
FIG. 6 is a cross-section diagram of a customizable playing field according to an embodiment of the invention.

FIG. 6 illustrates a turf system including a plurality of tiles, such as the tiles 100 described herein, or any other appropriate tile for supporting a turf overlay 500, and preferably an artificial turf rug. As is known to those of skill in the art, the turf rug 500 may be split into sections (e.g., sections the size of the tile) such that, when multiple tiles 100 are attached together, the turf sections come together to form a continuous rug. The turf system is disposed over a subfloor 600 defining a reservoir 610. The reservoir 610 may be configured to support one or more customizable modules as described below.

Figure 7:
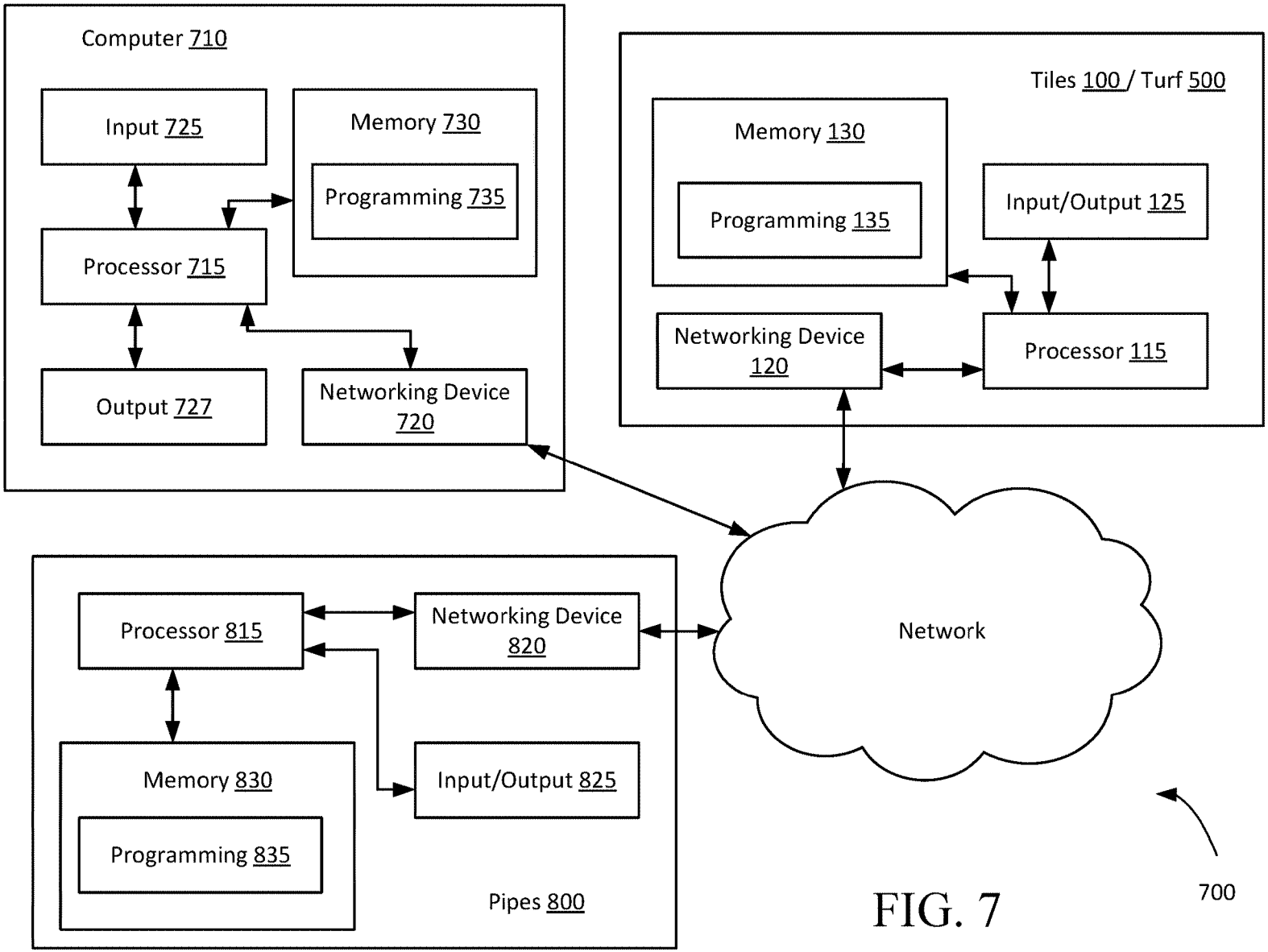
FIG. 7 is a system diagram of a customizable playing field according to an embodiment of the invention.

Referring to FIG. 7, in embodiments, the customized playing field system 700 includes one or more modules configured to provide a customizable playing experience. The system 700 comprises a computing device 710. The computing device 710 may be any computing device, such as a desktop computer, a laptop computer, a smart phone, a tablet, a web server or other server, and the like. In embodiments, the computing device 710 is a dedicated computing device adapted to operate in line with the teachings of the present disclosure.

The computing device 710 may include a processor 715, which may be in data communication with a network interface 720, an input device 725, an output device 727, and a memory 730. Processor 715 represents one or more digital processors. Network interface 720 may be implemented as one or both of a wired network interface and a wireless network interface, as is known in the art. The input device 725 may include a keyboard, a mouse, a stylus pen, buttons, knobs, switches, and/or any other device that may allow a user to provide an input to the system 700 via the computing device 710. In some embodiments, the input device 725 may comprise a media port (such as a USB port or a SD or microSD port) to allow for media (e.g., a USB drive, a SD or micro SD drive, a laptop memory, a smart phone memory, and the like) to be communicatively coupled to the computing device 710. The output device 727 may include one or more visual indicators (e.g., a display, touch screen), audible indicators (e.g., speakers), or any other such output device now known or subsequently developed. As is described in greater detail below, in embodiments, the output device 727 may include a mechanical device, such as a pump, in operable communication with the processor 715 for controlling the movement of fluid through the system. In some embodiments, at least a part of the input device 725 and the output device 727 may be combined. In some embodiments, the input device 725 may include a plurality of input devices 725, and/or the output device 727 may include a plurality of output devices 727.

Although shown within the computing device 710, memory 730 may be, at least in part, implemented as network storage that is external to the computing device 710 and accessed via the network interface 720. The memory 730 may house software 735, which may be stored in a transitory or non-transitory portion of the memory 730. Software 735 includes machine readable instructions that are executed by processor 715 to perform the functionality described herein. In some example embodiments, the processor 715 may be configured through particularly configured hardware, such as an application specific integrated circuit (ASIC), field-programmable gate array (FPGA), and the like, and/or through execution of software (e.g., software 735) to perform functions in accordance with the disclosure herein.

The computing device 710 is in selective communication with tiles 100, e.g., over a network. The tiles 100 may be equipped with a processor 115, networking device 120, memory 130 and programming 135 stored in the memory 130. The processor 115, networking device 120, and memory 130 may be substantially similar to the processor 715, networking device 720, and memory 730. The programming 135 includes machine readable instructions that are executed by processor 115 to perform the functionality of the tiles 100 as described here. The tiles 100 further include a plurality of input/output devices 125. In one embodiment, the plurality of input/output devices 125 comprise a plurality of supports 165 as shown in FIG. 6.

The supports 165 may extend from the subfloor 600 to the tile 100 to provide reinforcement for the tiles 100. As will be further understood from the description provided below, it may be desirable for the supports 165 to be selectively flexible. Accordingly, in embodiments, the supports 165 comprise a spring, such as a helical compression spring, or other actuator, such as a hydraulic actuator.

The tension of the supports 165 may be selectively adjusted to allow for increased functionality of the customizable playing field. For example, it may be desirable for a playing field where football is being played to provide less give than a playing field where soccer is played. In an embodiment, a user interacts with the input device 725 on the computing device 710 to provide certain specifications regarding desired flexibility depending on the sport. For example, the user may input threshold force values for the supports 165 based on each sport played on the field. For football, for example, the force may be greater (e.g., 10 lbf/in) than the force for soccer (e.g., 3 lbf/in). Once the desirable force values are stored in the memory 730, a user may access the values by selecting the sport currently played on the playing field via the input device 725. Similarly, a user may input appropriate values for other supports 165, such as hydraulic actuators according to known methods. Once the sport is selected, the computing device 710 may provide the information over the network to the tiles 100, the processor 115 operable to adjust the support 165 to allow for greater flexibility.

In an embodiment, the input/output device 125 may include a plurality of sensors in communication with the supports. The sensors 125 may be pressure sensors, infrared sensors, cameras, accelerometer, RFID sensors, or any other sensor now known or later developed, and combinations thereof. The sensors 125 may be located at various places around the playing field for the purpose of determining the location of a player upon the field. The sensors 125 may be operable to determine a likelihood of a player falling onto the field at a particular location and to effectuate a change in the flexibility of the supports 165 in the vicinity of the location. As an example, the sensors 125 may be RFID sensors, which may be in communication with RFID chips attached to a player's clothing, or worn on a player's body. When the RFID sensor determines that the RFID chip is within a predetermined distance to the RFID sensor, then the supports 165 within a certain radius of the RFID sensor (e.g., 5 feet, 10 feet, etc.) may be adjusted to increase the flexibility of the area of turf within the radius prior to the player falling on the field. This may be substantial, as it is believed that nearly 15% of concussions may be due to a player's contact with the field, and not the impact of one player with another.

The sensors 125 may additionally be used by teams to track players over a predetermined period of time in order to analyze plays and positions of players during the plays. For examples, players may be tracked during a practice, or during a game, and the sensors may record the information and store it in the memory 130. The sensors 125 may monitor the activities occurring on the field. For example, the sensors 125 may track players using, for example, radio frequency identification (RFID) technology. This could be useful for recruiting analysts and TV networks, for example, to easily track the various plays that a particular player has participated in during a predetermined time period (e.g., during the first half, over the course of one game, or a season).

Information may be transmitted (e.g., wirelessly over a network, or using any other methods currently known or later developed) to a memory device such as memory 130 and/or 730 which may store the information. Alternately, the recording may then be accessed by a user by engaging with the input device 725 on the computing device 710 which is in communication with the memory 130 over the network.

In another embodiment, the input/output device 125 includes a plurality of light emitting fibers, such as fiber optic cables, woven into the rug 500. Alternately, light diodes 125 may be located on selective ends of the synthetic turf 500. The synthetic turf 500 may include, for example, approximately 25% to 50% fiber optic fibers 125, or light diodes may be present on approximately 25% to 50% of the synthetic turf fibers. The fiber optic cables may be utilized to mark the field with indicia, for example, advertisements, or markings associated with play calling. The fiber optic technology may be synced with one or more sensors 125 configured to identify locations of players, as described above.

The sensors 125, in communication with the programming 135 may be configured to track footsteps in order to determine the most trafficked area of the field for the purpose of setting advertising prices. For example, if it is determined that play on a particular field occurs on the right hash mark of the north side of the field approximately 75% of the time, the owners of the field could charge more for advertising near that hash mark. Additionally, knowing precise locations of players may allow advertisements to move along the field with the movement of the players from one end of the field to another. Accordingly, the programming 135 may cause the fiber optic fibers to be selectively activated based on positioning of players on the field.

The turf rug 500 additionally optionally includes solar fibers which may be tufted into the rug alongside the synthetic turf fibers. The solar fibers may be connected to an external battery (e.g., a Tesla® battery) for storing solar energy. The battery may then be connected to various applications which require energy, such as the concession stand. It shall be understood by those of skill in the art that the solar fibers may be flexible such that the fibers are virtually indistinguishable from the synthetic turf fibers.

Figure 8A:
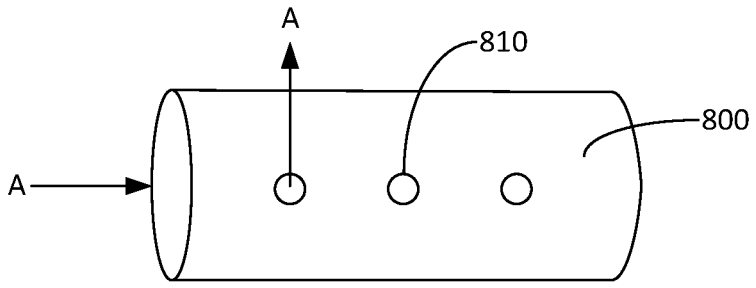
FIG. 8A is a top view of a section of a pipe for a customizable playing field according to an embodiment of the invention.
Figure 8B:
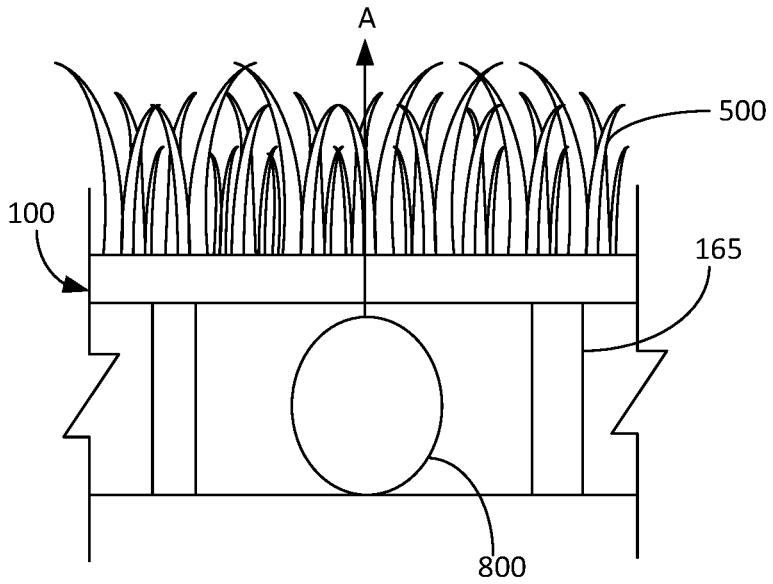
FIG. 8B is a cross-section diagram of a customizable playing field having a pipe distributed there through according to an embodiment of the invention.

According to another embodiment of the invention, the system 700 may additionally, or alternately include means for forcing fluids under the tiles 100. For example, in one embodiment, the tiles 100 may be configured to receive pipes 800 thereunder. The pipes 800 may be equipped with a processor 815, a networking device 820, an input/output device 825, memory 830, and programming 835. The processor 815, networking device 820, and memory 830 may be substantially similar to processor 715, networking device 720, and memory 730. The Referring to FIGS. 8A and 8B, the pipes 800 may include a plurality of openings 810. Air (denoted by reference A) may be forced through the pipes 800, and a portion of the air A escapes through the openings 810. As shown in FIG. 8B, the pipes 800 may be positioned beneath the tiles 100 such that air A can travel through the tiles 100 and the turf rug 500. The openings 810 may be selectively closed, e.g., via an actuating system 825 (e.g., an input/output device 825) which may be controllable via the processor 815 in communication over the network with the processor 715 via the input device 725 on the computing device 710. One end of the pipe 800 may additionally be selectively openable for releasing fluids.

In embodiments, the tiles 100 may be molded such that the pipes 800 fit within predetermined spaces underneath the tiles 100. Alternately, spaces may be cutout or otherwise formed into the underside of the tiles 800. In still other embodiments, the tiles 100 are simply positioned above the pipes 800, the supports 165 defining the spaces for the pipes 800. The pipes 800 may be rigid or flexible, or a combination of rigid and flexible depending on the needs of the system as described herein.

The pipes 800 are operatively coupled to one or more pumps (e.g., input/output devices 825) for forcing hot or cold fluid there through. Optionally, sensors 825 and/or 725 may monitor the ambient temperature of the air around the field. When the temperature is above a predetermined threshold (e.g., as defined in the programming 735 and/or 835), cold fluid may be forced through the pipes 800. If the temperature is below a predetermined threshold, hot fluid may be forced through the pipes. Those of skill in the art shall understand that a fluid can be air or some other gas, or a liquid such as water.

The pumps 825 may optionally force the fluid through a heat exchanger in order to set the fluid at the appropriate temperature prior to the fluid being forced through the pipes 800 according to known methods. Forcing hot air through the pipes 800 may be beneficial to, for example, melt snow that accumulate on the turf 500. Optionally, a drainage system may direct the melted water to a reservoir, which may be used by the system, e.g., to pump through the pipes 800 as described herein. Hot air may additionally reduce the likelihood of tile breakage due to brittle behavior in cold weather, among other benefits.

The use of cold air and/or cold liquids may likewise be beneficial. Because synthetic turf 500 may retain heat more than real grass, persons on or near synthetic turf 500 may experience adverse effects of the hot surface. In an extreme situation, contact with the synthetic turf may cause burns to the person or animal coming into contact with the turf. The ability to diffuse some of the heat away from the synthetic turf surface may thus be extremely important. Accordingly, above a threshold temperature, cold air may be forced through the pipes 800.

Still further, the pipes 800 may deliver liquids such as water to the turf 500 in embodiments where the turf 500 is real grass. As mentioned above, excess liquid may drain into a reservoir so as to conserve water for future use. It may be desirable to selectively close the openings 810 in the pipes 800 such that fluid may remain in the pipes 800 during periods of non-fluid transfer. When fluids are desired to be deposited, the openings 810 may be opened and fluid forced through the pipes 800 and out the openings 810.

Figure 9A:
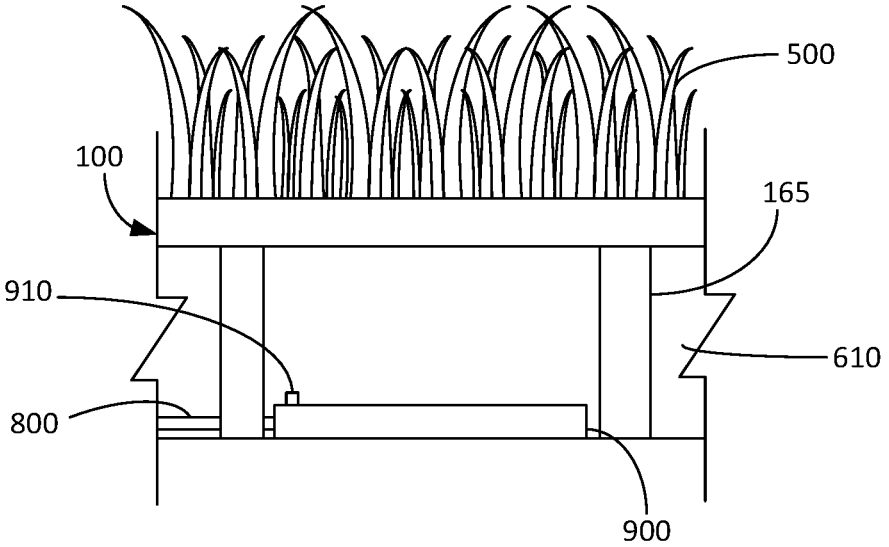
FIG. 9A is a cross-section diagram of a customizable playing field having a deflated bladder disposed therein.
Figure 9B:
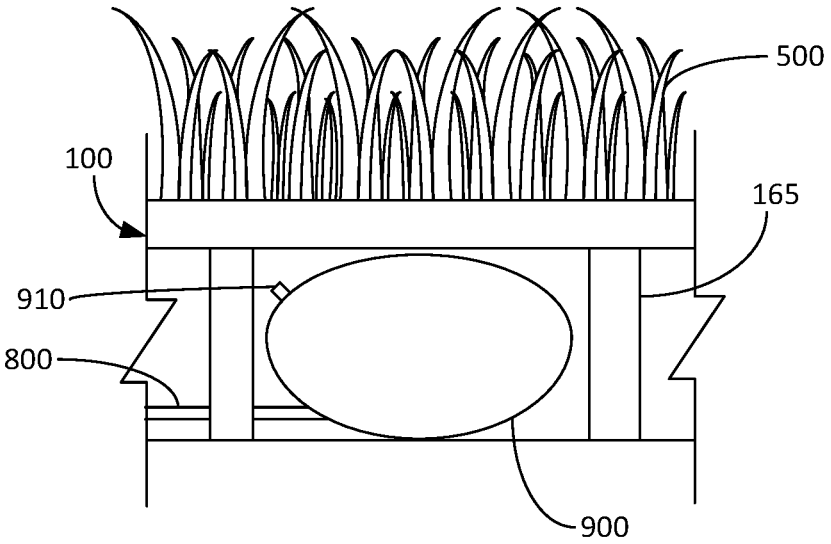
FIG. 9B is a cross-section diagram of the customizable playing field of FIG. 9A with the bladder inflated.
Figure 10:
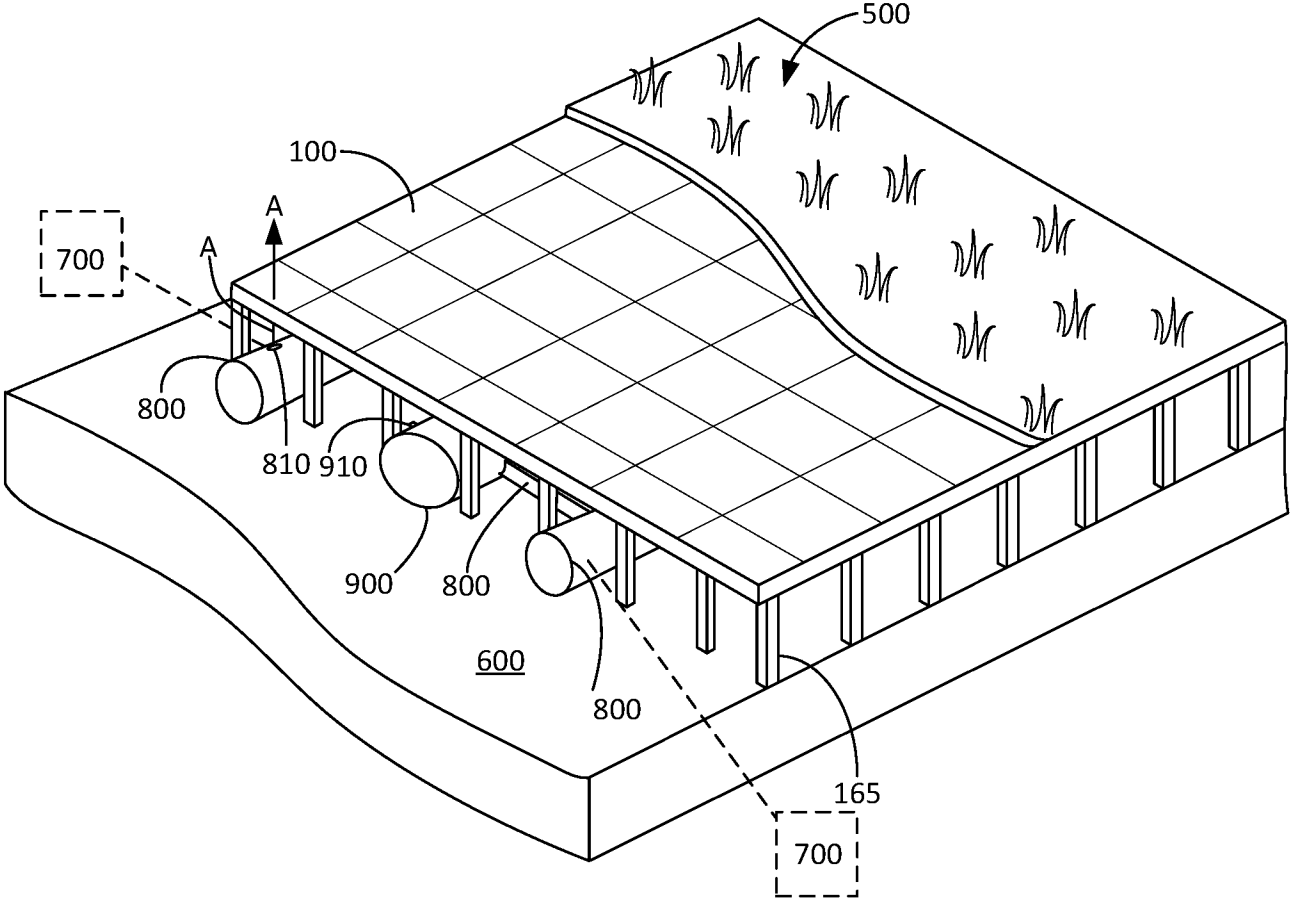
FIG. 10 is a cut-away perspective view of a tile installation system on a subsurface according to embodiments of the invention.

In some embodiments, the forced air may travel through pipes 800 without openings 810. Here, the pipes 800 may be operatively connected to bladders which may be selectively filled to function as an attenuation system. An exemplary attenuation system is shown in FIGS. 9A and 9B. The system includes a plurality of bladders 900 (which functions as an output device 825 according to FIG. 7). The bladder 900 is preferably, though not necessarily, located underneath the tiles 100. In FIG. 9A, the bladder 900 is deflated. In FIG. 9B, the bladder 900 is inflated. As is shown in the figures, when the bladder 900 is inflated, the bladder 900 may come into contact with an underside of the tile 100 and the subfloor 600. When a force is received upon the tile 100, the tile 100 via the inflated balder 900 may receive and deflect a portion of the force. Accordingly, serious injuries may be prevented.

In FIGS. 9A and 9B, the bladder 900 is shown in use in conjunction with supports 165. It shall be understood that the bladder 900 may be utilized with or without the supports 165. As described above concerning the supports 165, sensors 125 on the tiles 100 may predict a location of a potential impact, and one or more bladders 900 may be inflated prior to impact based on the predicted impact location. In embodiments, it may be preferable for the bladders 900 to be partially inflated at all times such that the bladders 900 may be easily and quickly inflated to capacity (or near capacity).

In embodiments, the bladders 900 may additionally be utilized to level the playing field. For example, sensors on the tiles 100 may provide real time information on the planarity of the surface of the field. For example, if each tile is connected together in a grid, the system may be configured such that each tile 100 is aware of its surroundings. Programming 135, 735, and/or 835 may cause one or more of the bladders 900 to inflate or deflate to in order to maintain a planar surface and to keep the playing surface as safe as possible. In embodiments, the bladder 900 contains a release valve 910. The release valve 910 may be configured to trigger if the volume, for example as measured by a volume sensor, of fluid in the bladder 900 exceeds a predetermined threshold such that the integrity of the bladder 900 may be questioned. The release valves 900 may additionally be selectively opened, e.g., via interaction with the input device 725, in order to deflate the bladders 900 after use.

In one embodiment, the bladders 900 may be provided, in a housing. A top of the housing may include a flat surface upon which the tiles 100 may be disposed. The top of the housing may be movable with respect to the sides of the housing, and therefore, may be allowed to move up and down as a result of movement on the turf surface or as a result of a change in the vertical space occupied by the bladders 900.

The synthetic turf system may include one or more of the components described above. For example, the owner of a synthetic turf system may desire a field that incorporates the attenuation features and is able to capture solar energy for power, but does not wish to incorporate fiber optics technology into the field. Or, the owner may desire to take advantage of only the player-sensing capabilities of the synthetic turf system. Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope.

A skilled artisan may develop alternative means of implementing the aforementioned improvements without departing from the scope of the present invention. Further, it will be understood that certain features and subcombinations are of utility and may be employed within the scope of the disclosure, Further, various steps set forth herein may be carried out in orders that differ from those set forth herein without departing from the scope of the present method. This description shall not be restricted to the above embodiments.

The invention claimed is:

1. A customizable playing field, comprising:

a turf system comprising a tile having a turf layer disposed thereon, the tile overlaying a subfloor defining a reservoir;

a first pipe disposed within the reservoir and operatively coupled to a pump;

a second pipe operatively connected to the pump, the second pipe being operatively connected to a bladder, wherein the bladder is selectively inflatable;

a first sensor; and a control system operable to control the pump, the control system comprising a processor in data communication with at least one input/output device, and computer memory, the computer memory comprising a program having machine readable instructions that, when effected by the processor, perform the following steps:

a. if the temperature is above a predetermined threshold as measured by the first sensor, forcing a cool fluid through the first pipe;

b. if the temperature is below a predetermined threshold as measured by the first sensor, forcing a warm fluid through the first pipe; and c. selectively inflate the bladder by forcing a fluid through the second pipe.

2. The system of claim 1, wherein the first pipe has a plurality of openings formed therein, the cool or warm fluid being forced out of the first pipe through the openings.

3. The system of claim 2, wherein the openings are selectively closable via an actuating system.

4. The system of claim 1, further comprising a heat exchanger, wherein the heat exchanger receives a fluid having an ambient temperature and outputs the cool fluid or the warm fluid.

5. The system of claim 4, wherein the cool or warm fluid forced through the first pipe is a gas.

6. The system of claim 4, wherein the cool or warm forced through the first pipe fluid is a liquid.

7. The system of claim 1, further comprising a second sensor, wherein the second sensor determines a location of a player on the turf system.

8. The system of claim 7, wherein the second sensor is a plurality of sensors, and wherein the bladder is a plurality of bladders.

9. The system of claim 8, wherein the second sensors are operatively connected to the plurality of bladders, and wherein the program has machine readable instructions that, when effected by the processor, perform the following steps:

c. predict a location of an impact by the player upon the turf system;

d. inflate at least one of the bladders within a predetermined radius of the predicted location of the impact.

10. The system of claim 8, further comprising a flexible support extending from the subfloor to the tile to support the tile.

11. The system of claim 1, further comprising a second sensor, wherein the second sensor determines a location of a player on the turf system.

12. The system of claim 11, wherein the turf layer comprises a plurality of light emitting fibers woven therein, the light emitting fibers being selectively activated based on the location of the player.

13. The system of claim 12, wherein the turf layer further comprises a plurality of solar fibers operatively coupled to an energy storage device for storing solar energy.

14. A customizable playing field, comprising:

a turf system comprising a tile having a turf layer disposed thereon, the tile overlaying a subfloor defining a reservoir, and a hydraulic actuator extending between the subfloor to the tile to support the tile;

a forced air system comprising a first pipe disposed within the reservoir and operatively coupled to a pump;

a first sensor; and a control system operable to control the pump, the control system comprising a processor in data communication with at least one input/output device, and computer memory, the computer memory comprising a program having machine readable instructions that, when effected by the processor, perform the following steps:

a. if the temperature is above a predetermined threshold as measured by the first sensor, forcing a cool fluid through the first pipe; and b. if the temperature is below a predetermined threshold as measured by the first sensor, forcing a warm fluid through the first pipe.

15. The system of claim 14, wherein the turf layer comprises a plurality of light emitting fibers woven therein.

16. The system of claim 15, further comprising a second sensor for determining a location of a player on the turf system, wherein the light emitting fibers are selectively activated based on the location of the player.

17. The system of claim 14, wherein the control system is further operable to adjust a resistance of the hydraulic actuator, and wherein the program has machine readable instructions that, when effected by the processor, perform the following steps:

a. receive a threshold value of tension for the hydraulic actuator for a first sport via the input/output device;

b. receive a threshold value of tension for the hydraulic actuator for a second sport via the input/output device;

c. receive a request to set the threshold value of resistance for the first sport via the input/output device; and d. adjust the resistance in the hydraulic actuator to correspond to the threshold value for the first sport.

18. A customizable playing field, comprising:

a turf system comprising a tile having a turf layer disposed thereon, the tile overlaying a subfloor defining a reservoir, and a compression spring extending between the subfloor to the tile to support the tile;

a forced air system comprising a first pipe disposed within the reservoir and operatively coupled to a pump;

a first sensor; and a control system operable to control the pump, the control system comprising a processor in data communication with at least one input/output device, and computer memory, the computer memory comprising a program having machine readable instructions that, when effected by the processor, perform the following steps:

a. if the temperature is above a predetermined threshold as measured by the first sensor, forcing a cool fluid through the first pipe; and b. if the temperature is below a predetermined threshold as measured by the first sensor, forcing a warm fluid through the first pipe.

19. The system of claim 18, wherein the turf layer comprises a plurality of light emitting fibers woven therein.

20. The system of claim 19, further comprising a second sensor for determining a location of a player on the turf system, wherein the light emitting fibers are selectively activated based on the location of the player.

* * * * *